US007510486B2

(12) United States Patent
Werner et al.

(10) Patent No.: US 7,510,486 B2
(45) Date of Patent: Mar. 31, 2009

(54) ELASTIC GOLF CLUB HEAD

(75) Inventors: Frank Werner, Teton Village, WY (US); Richard Greig, Jackson, WY (US)

(73) Assignee: Origin, Inc., Jackson, WY (US)

( * ) Notice: Subject to any disclaimer, the term of this patent is extended or adjusted under 35 U.S.C. 154(b) by 497 days.

(21) Appl. No.: 11/236,055

(22) Filed: Sep. 27, 2005

(65) Prior Publication Data

US 2006/0068937 A1 Mar. 30, 2006

Related U.S. Application Data

(60) Provisional application No. 60/614,921, filed on Sep. 30, 2004.

(51) Int. Cl.
*A63B 53/04* (2006.01)

(52) U.S. Cl. ..... 473/345; 473/350

(58) Field of Classification Search ..... None
See application file for complete search history.

(56) References Cited

U.S. PATENT DOCUMENTS

| | | | | |
|---|---|---|---|---|
| 769,939 | A | 9/1904 | Clark | 473/329 |
| 3,659,855 | A | 5/1972 | Hardesty | 473/342 |
| 4,398,965 | A | 8/1983 | Campau | |
| 4,461,481 | A | 7/1984 | Kim | 473/333 |
| 4,535,990 | A | 8/1985 | Yamada | |
| 4,591,160 | A | 5/1986 | Piragino | 473/326 |
| 4,614,627 | A | 9/1986 | Curtis et al. | |
| 4,681,321 | A | 7/1987 | Chen et al. | |
| 4,730,830 | A | 3/1988 | Tilley | 473/337 |
| 4,928,965 | A | 5/1990 | Yamaguchi et al. | |
| 4,930,781 | A | 6/1990 | Allen | |
| 4,944,515 | A | 7/1990 | Shearer | |
| 5,060,951 | A | 10/1991 | Allen | |
| 5,176,383 | A | 1/1993 | Duclos | 473/329 |
| 5,288,070 | A | 2/1994 | Chen | |
| 5,301,941 | A | 4/1994 | Allen | |
| 5,407,202 | A | 4/1995 | Igarashi | 473/342 |

(Continued)

FOREIGN PATENT DOCUMENTS

JP 2005230472 A * 9/2005

OTHER PUBLICATIONS

Definition of "diamond", Merriam-Websters Dictionary, www.m-w.com.*

(Continued)

*Primary Examiner*—Gene Kim
*Assistant Examiner*—Alvin A Hunter
(74) *Attorney, Agent, or Firm*—Westman, Champlin & Kelly, P.A.

(57) ABSTRACT

A golf club head, more specifically a driver head, has a shell structure aft of the face that has ample strength but also can deform in the fore-aft direction for off-center hits sufficiently to provide good spring effect for such hits, comparable to hits at the center. Unwanted scatter caused by off-center hits is reduced with the spring design used in the shell structure. The shell structure can be applied to other hollow wood-type club heads. The shell structure can be provided with a coat or cover to close openings in the shell structure, and selected to make little change in stiffness or mass of the shell.

20 Claims, 9 Drawing Sheets

U.S. PATENT DOCUMENTS

| | | | | |
|---|---|---|---|---|
| 5,464,211 | A | 11/1995 | Atkins, Sr. | 473/377 |
| 5,467,983 | A | 11/1995 | Chen | |
| 5,480,153 | A | 1/1996 | Igarashi | 473/345 |
| 5,494,281 | A | 2/1996 | Chen | |
| 5,497,993 | A | 3/1996 | Shan | 473/629 |
| 5,499,814 | A | 3/1996 | Lu | |
| 5,505,453 | A | 4/1996 | Mack | |
| 5,547,427 | A | 8/1996 | Rigal et al. | 473/345 |
| 5,586,947 | A | 12/1996 | Hutin | 473/324 |
| 5,586,948 | A | 12/1996 | Mick | 473/332 |
| 5,669,828 | A | 9/1997 | Schmidt | 473/345 |
| 5,743,813 | A | 4/1998 | Chen et al. | 473/329 |
| 5,772,529 | A | 6/1998 | Ruth, Jr. | 473/327 |
| 5,807,190 | A | 9/1998 | Krumme et al. | 473/342 |
| 6,007,435 | A | 12/1999 | Chern | 473/342 |
| 6,093,114 | A * | 7/2000 | Haringa | 473/329 |
| 6,152,833 | A | 11/2000 | Werner et al. | 473/324 |
| 6,165,081 | A | 12/2000 | Chou | 473/329 |
| 6,319,150 | B1 | 11/2001 | Werner et al. | 473/349 |
| 6,348,015 | B1 | 2/2002 | Kosmatka | 473/342 |
| 6,354,956 | B1 | 3/2002 | Doong | 473/219 |
| 6,354,961 | B1 | 3/2002 | Allen | 473/329 |
| 6,672,975 | B1 | 1/2004 | Galloway | 473/342 |
| 7,108,614 | B2 * | 9/2006 | Lo | 473/345 |
| 2001/0001773 | A1 | 5/2001 | Naruo et al. | |

OTHER PUBLICATIONS

The International Search Report from Application No. PCT/US05/34322, filed on Sep. 27, 2005, and copy of Written Opinion.

Science and golf III by Johnson & Hubble, pp. 495, 488 and 501. The World Scientific Congress of Golf Trust. Published 1999.

"How Golf Clubs Really Work and How to Optimize Their Designs", Werner and Grieg. Origin, Inc. Published 2000.

"Better Golf From New Research", Werner & Grieg, Origin Inc. Published 2001.

VTF Technology advertisement; Wall Street Journal, Jun. 15, 2001.

Science and Golf II, Johnson p. 307. The World Scientific Congress of Golf Trust 1994.

* cited by examiner

ELASTIC GOLF CLUB HEAD

This application refers to and claims priority on U.S. Provisional Application Ser. No. 60/614,921, filed Sep. 30, 2004, the contents of which is incorporated by reference.

BACKGROUND OF THE INVENTION

Golf clubs and particularly the driver have been modified in recent years to have a so-called "spring effect." The spring effect is such that the hitting surface (called "face") is made to be less stiff and rigid than earlier designs. Upon head-ball impact near the face center, the face deflects within its elastic limit and it has been found that if this spring effect is optimized, the ball will travel some 5 to 15 yards farther than for previous designs. Hits that are somewhat off center do not fully realize this spring effect. As a result, in common terminology, this means the size of the "sweet spot"is undesirably small. A co-pending patent application Ser. No. 10/210,329, filed Aug. 1, 2002, shows that the rear part of the club head, called the "shell", may be made to have much less stiffness than usual designs. The shell can thus combine with flexibility of the face so that this spring effect is also at least partly experienced by hits that are off center, meaning near the perimeter of the club face. The present invention describes an unusual mechanical design for the shell walls such that a metal shell can be made to have reduced stiffness to the desired degree. This is an important advantage because ordinary designs of metal shells having the desired stiffness would require corrugations or other features and would have more weight than can be tolerated. If made very long in the front-back dimension of the club head, a metal shell of conventional nature would be far too long for all known metals for the desired front-to-back stiffness.

The co-pending patent, Ser. No. 10/210,329, filed Aug. 1, 2002, describes a club head shell structure having acceptable weight and acceptable stiffness for hits away from the face center and particularly for hits near the perimeter of the face. One way this is achieved is by use of plastic material for the shell such as polycarbonate. It has low enough stiffness in compression for the purpose without excessive weight. It describes other ways of providing the desired stiffness, not like the present invention.

Bridge trusses and similar trusses used as floor beams are similar to the present invention in that they can store potential energy mainly in uniform compression or tension in the elements. They differ in that whereas the present invention uses a multiplicity of related structures in the direction of the applied load, trusses have no reason to have 2 or more truss structures acting on each other in the direction of the applied load. Such trusses also are more concerned with achieving high rigidity with minimal deformation under load, whereas the present invention is strongly concerned with relatively large deformation. Such trusses are not made from one piece of material, whereas this is a preferred method of construction of the present invention.

A fundamental comparison with prior art springs in general is the storage of energy per unit weight of the structure. As applied to a material having uniform stress at the elastic limit, the elastic energy stored in a cubic inch of material is sometimes called the "modulus of resilience" or as the "unit resilience". It varies in the structure as the local stress varies and may be measured as elastic energy stored per unit weight or per unit volume. Various references such as the 8th edition of Mark's "Standard Handbook for Mechanical Engineers" show resilience for beams in bending, coil springs, and numerous other structural configurations that have non-uniform stresses. For a given value of maximum stress, they store from as little as 1/12th to 1/2 as much energy per unit weight as the case of uniform tension or compression stresses (stresses that do not vary over the cross section considered). The preferred form of the present invention stores nearly as much energy as for uniform tension or compression. The result is substantial weight reduction for the novel spring over prior art.

SUMMARY OF THE INVENTION

The present invention is for a spring-like club head shell. It is primarily intended for "woods" and particularly for drivers. The preferred version causes the spring material to be primarily in either uniform compression or uniform tension. All ordinary springs have part of their structure that has little or no stress such as material near the center of the wire in coil springs. These parts add weight (more properly called "mass") and contribute little to the strength and stiffness. The preferred version of the present invention has nearly all of its material contributing to the spring effect with relatively little of the material having low stress. Another way to state this advantage is that the novel design can store more potential energy (or elastic energy) per unit of weight than conventional springs, and particularly those for designs suitable for the shell of a driver. We refer to it as a "shell spring"

DETAILED DESCRIPTION OF THE PREFERRED EMBODIMENTS

Figure 1:
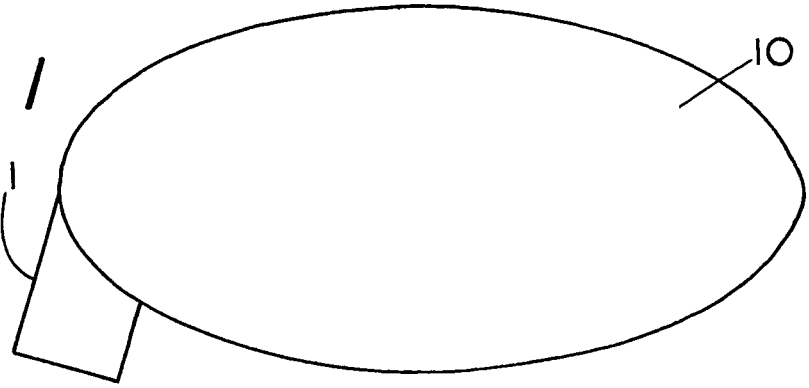
FIG. 1 shows the hitting face (called simply the "face") of a driver. It happens to be of generally elliptical shape. The present invention also applies to more common face shapes.
Figure 2:
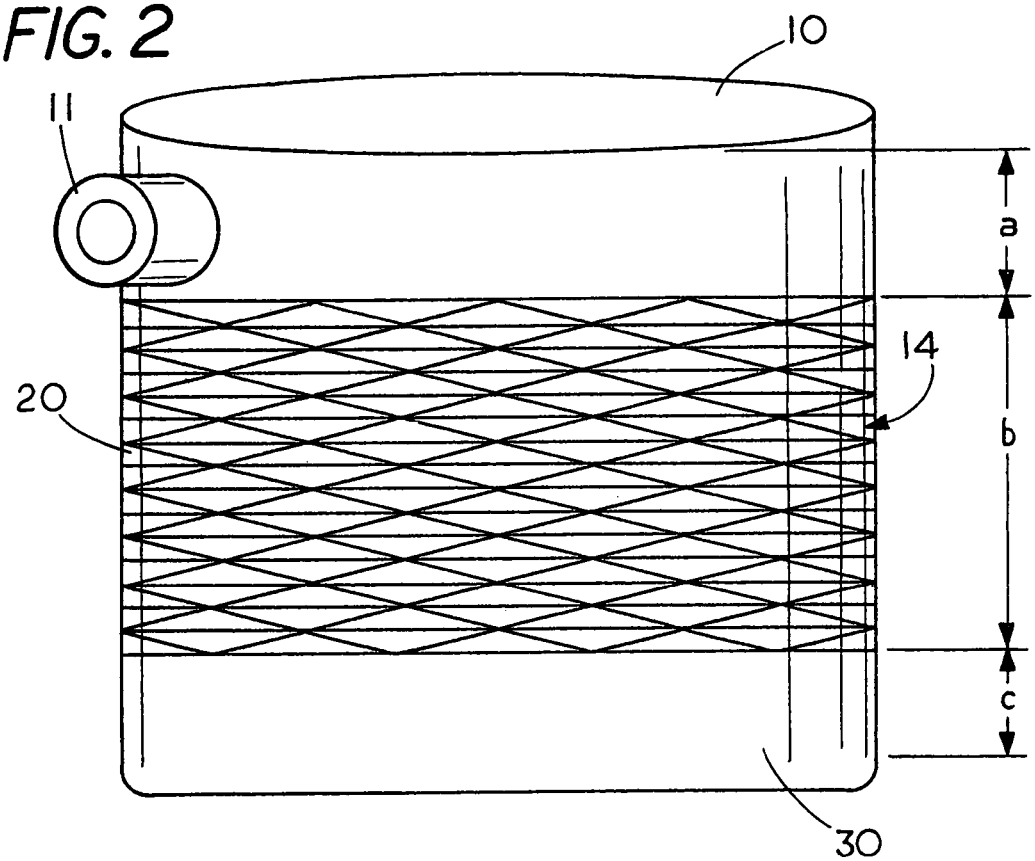
FIG. 2 shows a top view of a golf driver head. It happens to have rather unusual shape, being more square and not having a rounded shell shape as is usual. The present invention can also be adapted to more common, rounded head shapes.
Figure 3:
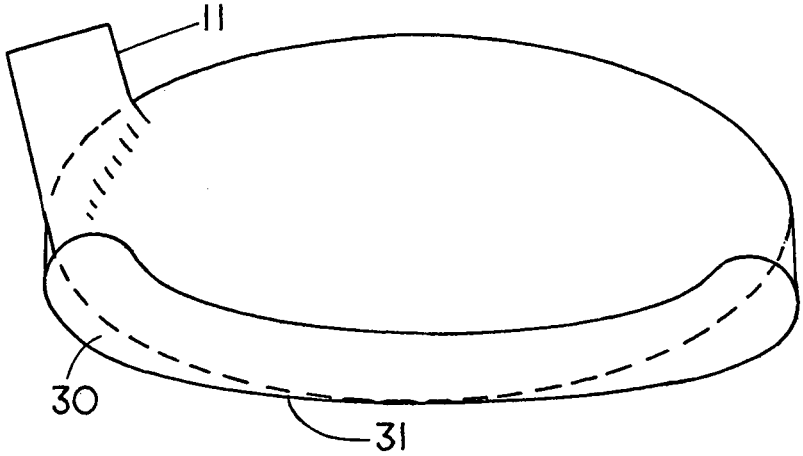
FIG. 3 shows a rear view of the driver head and again it has unusual shape, not essential to the present invention.
Figure 12:
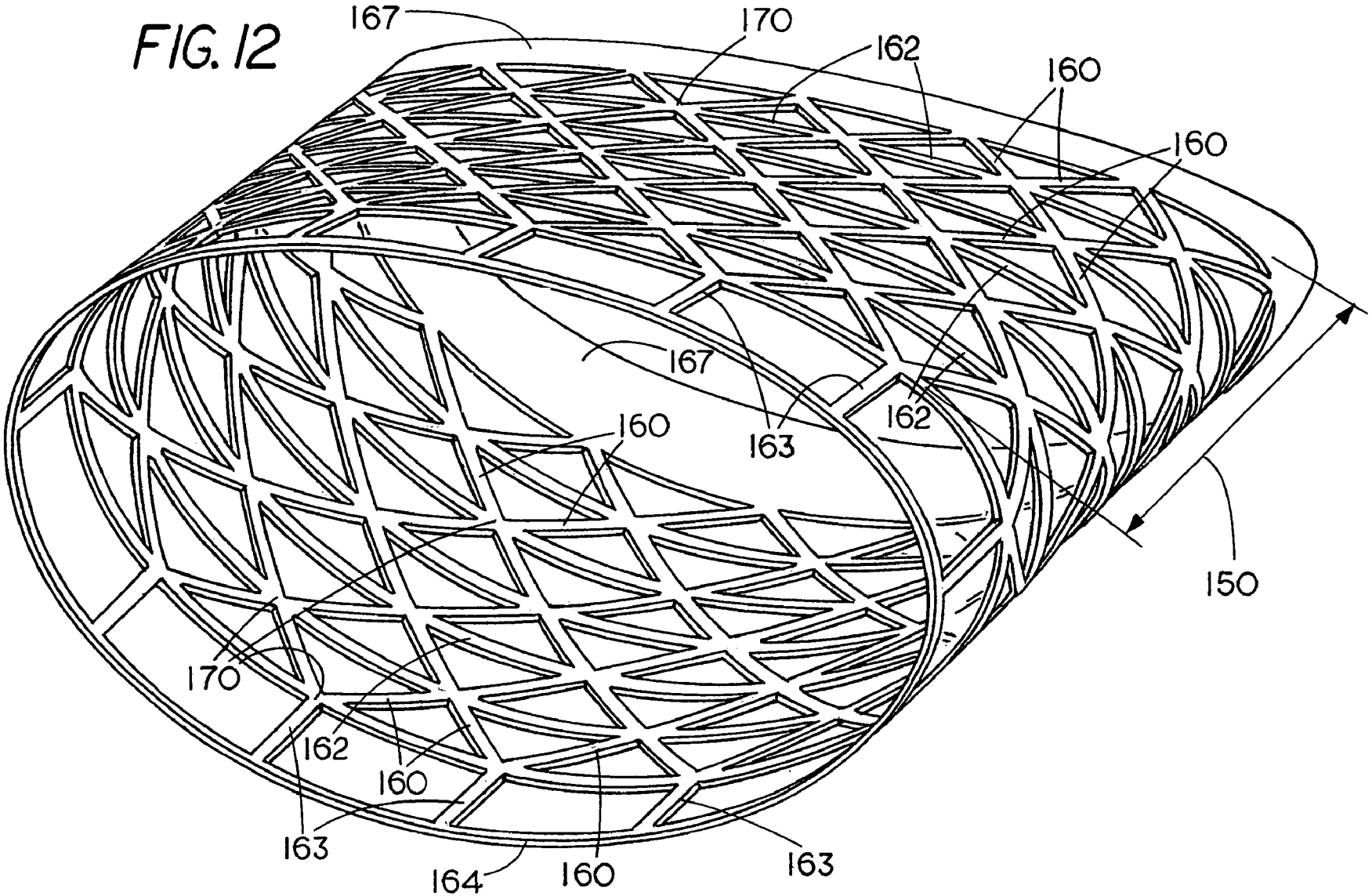
FIG. 12 is an isometric illustration view showing the spring-like element in FIG. 11 formed into a central shell portion for a shell for a golf club head.

An unusual shape of a driver head is shown in FIGS. 1, 2 and 3. It has a face or "hitting face"labeled 10 in FIGS. 1 and 2. FIG. 3 shows a rear view. The parts aft of the face are labeled a, b, c, and 30 and collectively, are called the "shell". The portion labeled b and 14 is a novel elastic part of the shell called the "shell spring". Part a connects the shell spring to the face. Rearward from the shell spring is the "rear structure" 30 in FIG. 2. It is composed of the "rear plate" whose outline is labeled 31 together with part c called the "rear strap" which connects the shell spring to rear plate 31. The outline shape of rear plate 31 is rather arbitrary and a more preferred shape is shown in FIG. 12. The size and shape of the shell of FIG. 2 provides significantly larger moments of inertia and allows better design control of the center of gravity location than conventional driver head shapes. The present invention can also be applied to club heads of more conventional shape. The shell spring 14 is shown in "line" illustration and can have open or uncovered openings as shown, or may have openings covered with a shell or panel or coat of material having very low stiffness compared to stiffness of the shell spring, and very low weight.

The shell spring deforms upon impact with a golf ball, particularly if impact is off center such as near the perimeter of the face. The spring effect at impact for off-center hits is much reduced in conventional designs of faces having the spring effect together with a relatively stiff shell, but the spring effect is reduced much less for such hits by the present invention. In addition, such impacts locally alter the slope of the face and cause errors in the direction of the shot for conventional spring effect club heads. The present invention improves the spring effect for such hits and also can reduce the change of slope of the face surface. These results are realized by allowing the edge of the face near such impacts to deform much more than is possible by conventional designs.

A usual preference is to make the face and shell of titanium alloy but various other materials can be used, such as plastics filled with strong fibers, and materials not yet developed. In FIGS. 1, 2 and 3, numeral 11 is the hosel, which is the socket into which the club shaft (not shown) is attached, typically by epoxy bonding. The rear structure 30 may or may not have the same shape on its lower part (the "sole") as the lower part of face 10 as may be preferred by the designer. The upper part of structure 30 may have any of a variety of shapes.

Figure 4:
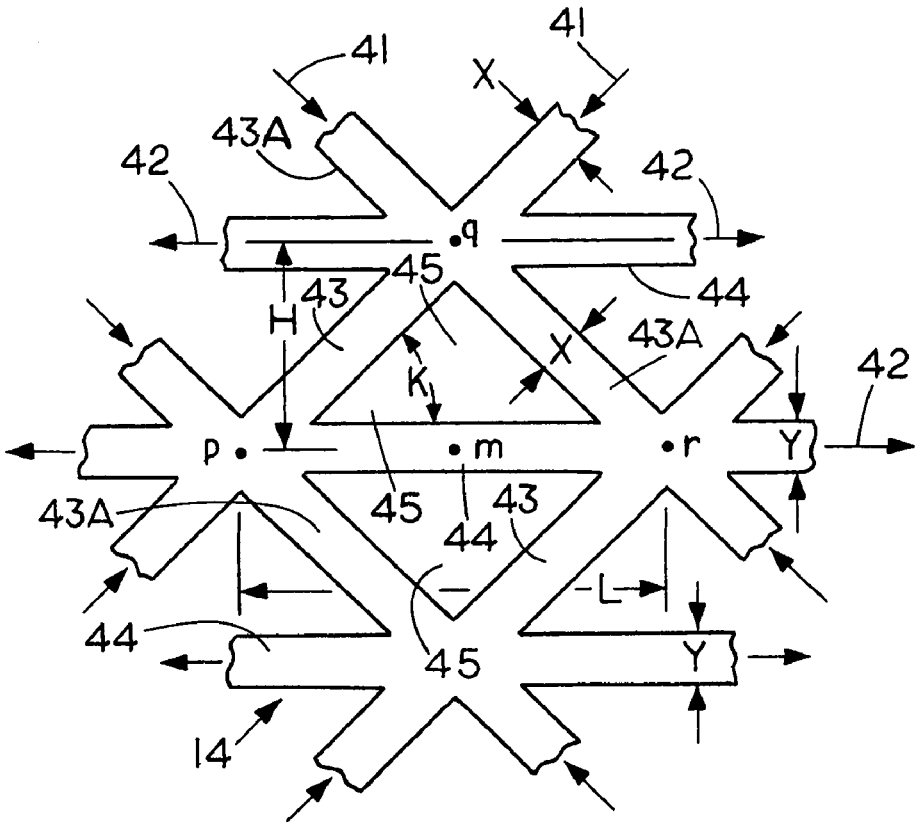
FIG. 4 shows detail of a preferred embodiment.
Figure 4A:
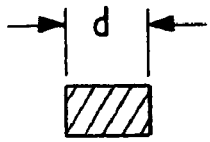
FIG. 4A is a cross sectional view showing the thickness of members shown in FIG. 4.

A detail of a preferred form of the shell spring 14 is shown fragmentarily in FIG. 4 and FIG. 4A. Arrows 41 indicate application of forces to cause compression loading in members 43 and 43A from the forces on the face 10 from ball impact. Arrows 42 are to represent tensile loads in tension carrying members or webs 44, caused by ball impact. The shell springs 43 and 43A are described as having compression loads 41, but function approximately the same when arrows 41 represent tensile rather than compression loads, such as happens on the rebound that follows after an impact.

For such compression loads the heavy lines in FIGS. 5-9 represent members loaded in compression and the light lines represent members loaded in tension. Thickness of the spring web members (perpendicular to the paper or inside to outside direction in a club head) is shown as dimension d in FIG. 4A. The width of the spring members is dimension x for compression members, and y for tensile members. To facilitate casting, at least some of the members 43 and 44 may be of a non-rectangular shape having the same cross sectional area. The dimensions d, x, and y may vary from front to back or even around the spring shell, to obtain a desired spring shell stiffness.

A triangular unit 45 of the shell spring is called a "cell." The cells are bounded by lines joining points p, q and r in FIG. 4 with half of the width being in a cell such as 45 and half in adjacent cells. The cell has length labeled L, and height labeled H. Such a cell is indicated by members having the round dots labeled p, q, r, and m. For convenience we have analyzed a half cell, such as the triangle p-q-m. The angle K, shown in FIG. 4 at rest, is a design parameter that depends on dimension d, x, y, H, L, the applied load, and the material properties of the webs bounding the cell. Dimensions H and L uniquely determine the length and height of the cell and the angle K. The selection of dimensions H & L depend on dimensions d, x, y, the spring shell circumference and depth, and the desired spring shell stiffness.

The intersections of axes of bars (or members) 43, 43A and 44 are shown as intersecting at points such as p, q, and r and this is preferred. The following discussion is primarily for this case. A less preferred arrangement is for such bars not intersecting at points that are common to all three axes of bars.

When compression loads 41 are applied, there is slight shortening of the compression members 43 and slight lengthening of the tensile members 44. There is little bending of the members. This allows good resilience per unit weight, nearly as good as the ideal case of uniform stresses (i.e. uniform throughout). The structural behavior is readily analyzed for tension and compression, though by rather cumbersome geometrical relations.

As an example of analysis, reasonable results had K=49 degrees, H=0.745 inch, L=1.3 inch, d=0.07 inch, x=0.067 inch, and y=0.077 inch. With loads approaching the yield strength of a strong titanium alloy (Ti-15-3-3-3) at 140,000 psi, the dimension "H" of each cell shown in FIG. 4 deforms 0.015 inch. With a suitable design in other respects, this represents ball impact at 150 miles per hour. This speed is above what golfers can achieve, but provides a design safety factor.

Figure 5:
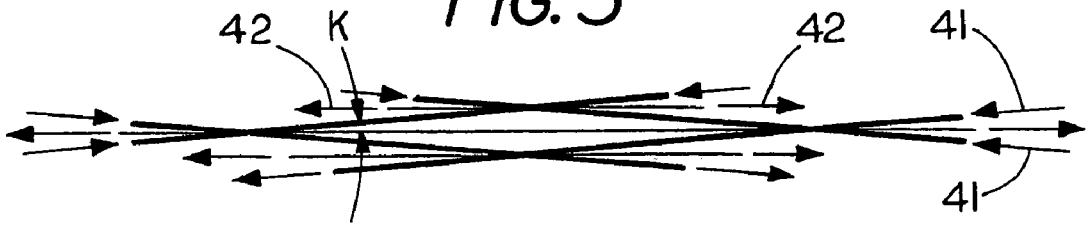
FIG. 5 shows detail of a highly distorted design of the present invention.

It was found that angle K could be as low as 10 degrees or less as indicated in FIG. 5 where thickness of the members is shown as simple lines. Near this extreme, the cell deviates substantially from the case of uniform compression and tension because bending of the tension and compression arms becomes prominent and much of the advantage of high resilience per unit weight is lost. The preferred angle K is from about 20 to 70 degrees. This makes the angle between bars 43 and 43A to vary between 40°and 140°.

Figure 6:
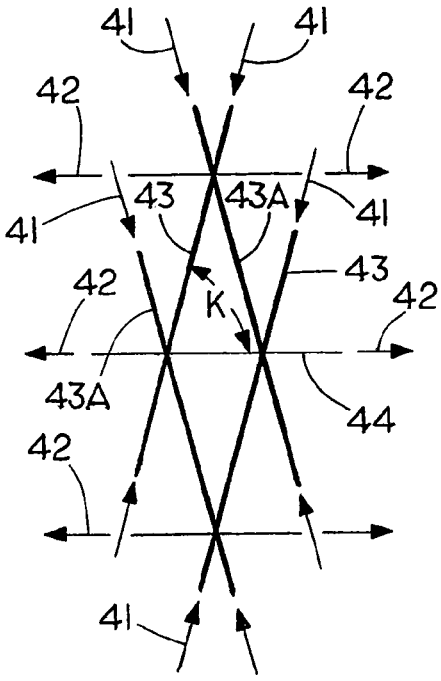
FIG. 6 shows another highly distorted design of the present invention.

When angle K is near 80 degrees as shown in FIG. 6, the structure allows little more elastic deformation at large loads than a simple, continuous sheet of the same material, when loaded to the same stress in compression parallel to the sheet's surface. While that preserves desired resilience, it greatly increases the length required in the compression direction for a given deflection at full load. This would be true for all materials used for the spring shell of a club head.

An assembly of such cells as described in FIG. 4 can then be used to make up the shell spring as indicated at part b in FIG. 2.

Figure 7:
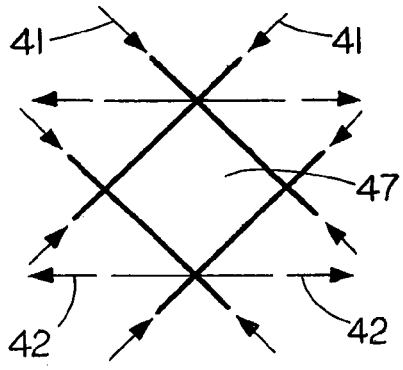
FIG. 7 shows a variation of the present embodiment.

The geometry of individual cells may be somewhat different. FIG. 7 shows one such change. Tension members 44 of FIG. 4 of select cells can be omitted resulting in a mixture of diamond and triangular cell shapes as shown at 47 in FIG. 7 as compared with FIG. 4. This provides a means for adjusting shell stiffness for desired performance.

Figure 8:
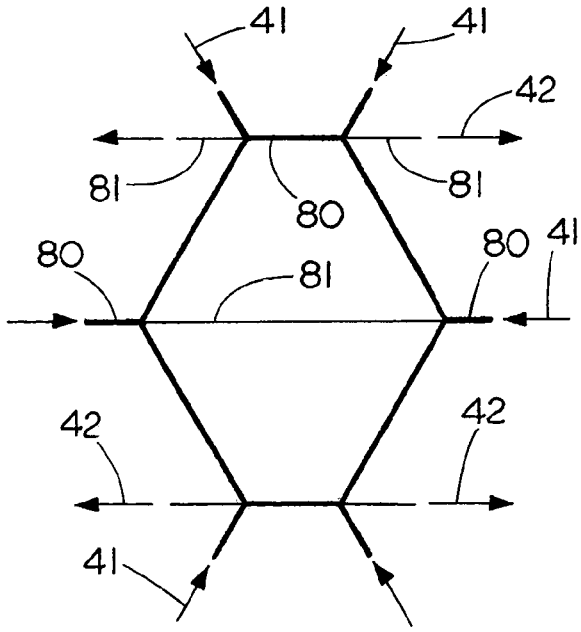
FIG. 8 shows another variation.

FIG. 8 shows still another geometry. In this case it is like FIG. 4 except that parts or webs 80 of the horizontal tension members become compression members, and parts (or bars) 81 are in tension.

Figure 9:
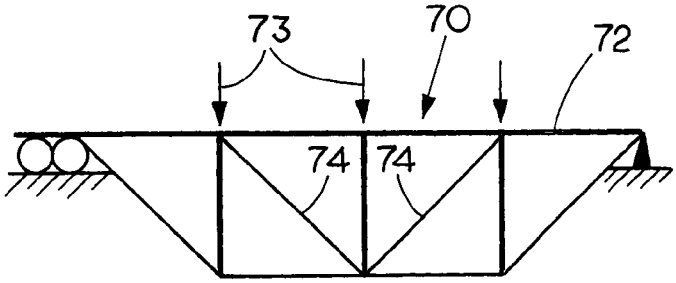
FIG. 9 shows a truss such as for a bridge or a floor joist for comparison.

FIG. 9 shows a truss 70 such as for a bridge or a floor joist. Its compression members 72 and tension members 74 are shown as dark and light lines respectively. It is loaded in the direction of arrows 73. It has much similarity to what has been described as shell springs, but for trusses, use as a spring is replaced by use as a strong member where spring effects are generally undesirable. A fundamental difference is that such truss members are not used in a multiplicity of layers as described above for the shell spring. As an indicator of non-obviousness, the inventors can be classed as being skilled in the art, but the concept of such trusses appeared only by considering patentability after much thought and analysis.

Manufacture of webs or bars defining the cells described can be by casting. A relatively complicated mold is required. An alternate is to use a flat sheet of metal and cut the openings required for each cell by punching out the triangular cell openings or by cutting them out by means of such methods as water jet cutting or laser cutting. Such a sheet is then bent to the desired shape and joined by welding to the other parts.

There remains the consideration of how such spring cells may be attached to the face plate and to the rear structure. In the case of a club head, the apex of each cell where two webs or members join such as point q in FIG. 4 could have the tension carrying member or element 44 removed. Each apex then could be individually welded to the face or to the rear solid wall. The face plate of a club head is generally not flat but curved to minimize the direction errors of hits near the perimeter. This means that cell apexes or junctions to be welded to the face plate could be modified in size or shape near the face plate or could be distorted in size so as to fit the face plate at each apex intended to be welded to the face. Alternately the members or webs forming the cells could simply be cut to fit as required with a weld at each tip or junction of the cell walls or elements where they happen to meet the curved face.

In the case where a more conventionally curved shell is desired, cell size may be varied so as to adapt to a shell shape that is not bent from a flat shape but has radii of curvature that may vary with direction from any point on the surface, such radii varying over various locations on the face plate perimeter.

It should be noted that during most of an impact of driver to ball, some elements are primarily in compression stress and are usually referred to as compression bars and some are primarily in tension stress and are usually referred to as tension bars. These compression and tension members have little bending stresses. There is normally a rebound at the end of the impact that reverses these compression and tensile stresses, even though they are defined for the impact as compression and tension members. Such tension and compression members are often referred to as "bars". The forward direction refers to the direction from the rear plate toward the face plate.

Another alternate is to provide a portion of the shell that has no perforations such as indicated at part a in FIG. 2. This section of non-perforated shell would alter the bending stiffness at the edge of the face plate and interfere with the desired stiffness for hits near the perimeter.

Figure 10:
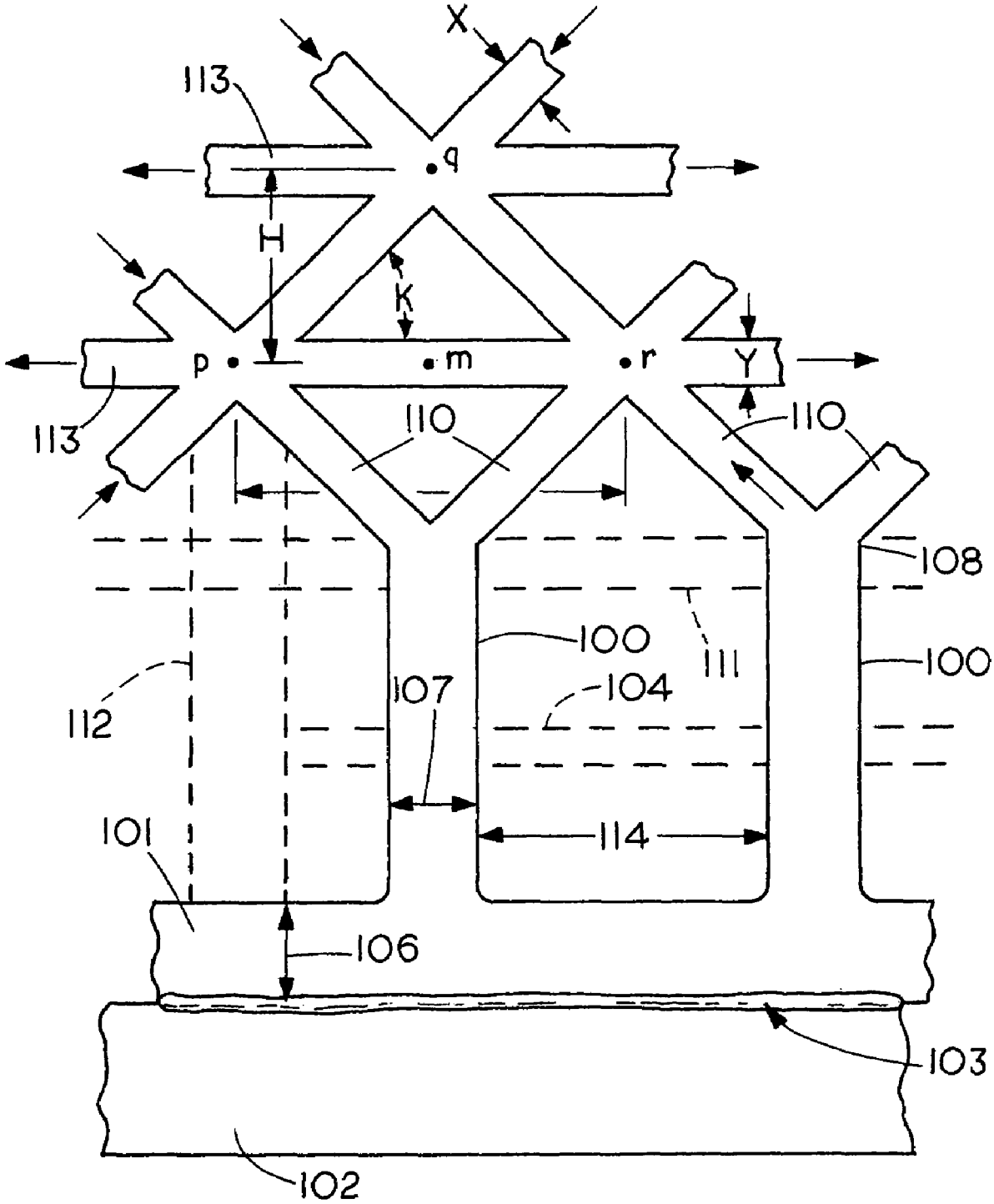
FIG. 10 shows one option for the detail of joining the shell spring to the back of the face and to the back of the rear part of the club head.

This is avoided as shown in FIG. 10. Short column members 100 can be formed with the assembly of cells by integrally forming the columns 100 at the junctions or apexes 108 of the webs 110. A member 101 joins the opposite ends of the columns 100 from junctions 108 that can be welded to face plate 102 as shown at a weld line 103. Various alternate configurations may be made to join the face to the spring shell structure. The rear structure 30 that is formed as a plate or block of metal can be joined similarly. This allows variation in fore-aft width 106 of the element or member 101 to be welded. The length of columns 100 can be varied to cause members 101 to be approximately of constant width and relatively narrow as shown at 106 in FIG. 10. The member 101 provides a continuous weld line 103 and therefore a much simpler welding process. It provides only a small effect on bending stiffness of the edge of the face plate for hits near the perimeter. Other welding or joining arrangements can be used. Upon impact, the columns 100 can bend slightly and within the elastic stress limits and thus adapt to the cells for hits near the perimeter. It may be desirable to provide one or more elements shown as dotted lines 104 to suppress any buckling tendency of the columns 100.

Additional options are shown in dotted lines at numerals 111 and 112. The members 111 are similar in size and shape to the members 113 and alter the function of the shell spring only to a small extent. The members 112 are similar to members 100 and reduce dimension 107 required for members 100 and reduce the size of the openings 114 between columns, should that be desired.

Figure 11:
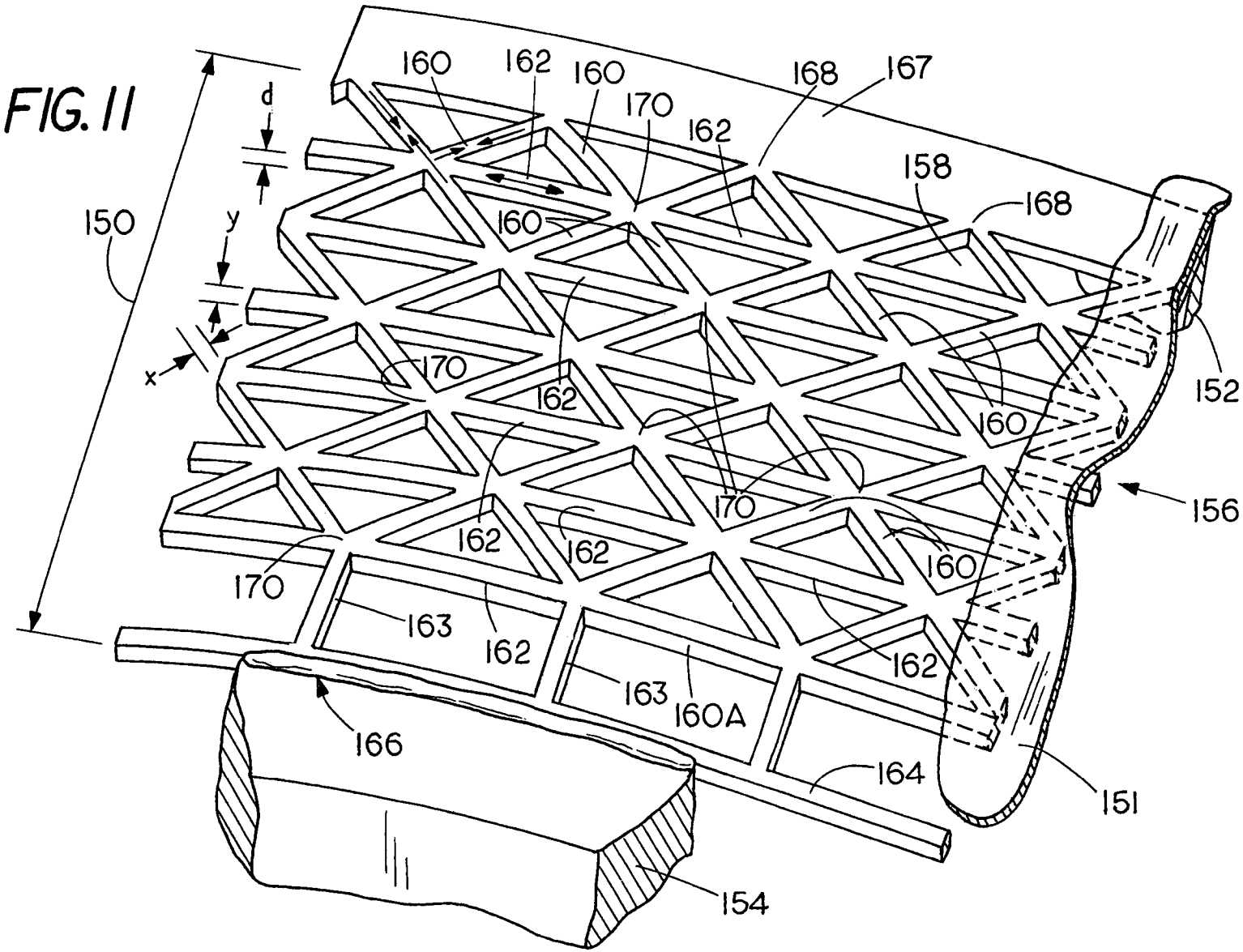
FIG. 11 is a fragmentary isometric view of computer generated model of the spring-like shell used for finite element analysis.

In FIG. 11, a computer generated model of the spring-like shell used for Finite Element Analysis is illustrated in perspective view and fragmentarily. In this view, the fore and aft length of the center part shown at b in FIG. 2 is illustrated, and is indicated at 150. In this instance, also, the rear plate 152 is shown fragmentarily, as is the front plate or face plate 154.

The shell spring 156 includes a plurality of spring members or webs forming cells, in the preferred embodiment indicated at 158. These cells are formed by compression carrying members 160, joined by tension carrying members 162 that are labeled throughout. At the face end of the spring section 156, a plurality of columns 163 are formed as previously explained and are supported on tension carrying members 160A. The columns 163 are joined by an end member or rib 164 that provides for a line weld 166 to the edge of the face plate 154.

At the rear of the golf club head, the compression carrying members are supported on an integral rear strap 167 that is integral with and joins to support the compression carrying members at their junctions or cell apexes 168.

In FIG. 11, the dimensions d (the inside to outside dimension); dimensions y, (the width dimension of the tension carrying members); and the dimension x, (the width of the compression carrying members) are also illustrated. The tension and compression carrying members are illustrated essentially as straight lines, but they can be slightly curved between the junction regions 170 where the compression carrying members of each cell are joined to compression carrying members of other cells that are also joined to the tension carrying member 162 extending between the junctions.

The shell structure comprising the shell spring 150 can be covered with a suitable elastic covering if desired, for appearance purposes, but provides a small or negligible structural stiffness between the face plate 154 and the rear plate 152 of a golf club head. In FIG. 11, 151 illustrates a very small part of such cover. Preferably the cover extends all around the shell spring, covering all openings.

Such head design provides the desired resilient characteristics that are useful for increasing the length of drives and the like in the game of golf.

As stated previously, the spring material can be preferably a titanium alloy, described previously. It is also possible that a plastic material could be used such as polycarbonate and still other materials may be used, such as may be developed in the future.

In the form of the invention shown in FIG. 11, the load on the face plate 154 at impact with a golf ball causes tension in the tension members 162 and compression in the compression carrying members 160. The tension members 162, included in the preferred embodiment, are not essential for operation.

The impact of the ball causes slight elongation of the tension members 162, and shortening of the compression members 160 and the individual deformations combine to provide the deformation of the shell at impact of the ball that in turn has a spring effect. Each of the members has a spring effect when loaded in tension or compression, and their spring effects combine to provide the stiffness of the shell that is desired. The tension members 160A, likewise are not required, but are in the preferred embodiment for joining the junctions of the compression members where the columns 163 carry the compression loading from the face plate to the spring effect sections.

Other shapes may be used to facilitate manufacture and joining of the cells to the face and to the rear structure, as discussed below for FIGS. 13 and 14.

FIG. 12 shows the central part b of FIG. 2 formed from the spring elements of FIG. 11. The shell spring structure 150 is formed as a tubular structure with open ends and the face plate and rear plate would be welded to the member 164 and strap 167 in a continuous line weld around the peripheries of the face plate and rear plate to complete the club head. Alternately, the rear plate 152 in FIG. 11 may be cast integrally with the strap 167 and the shell spring structure. The numbers in FIG. 12 are the same as those in FIG. 11 for the same elements.

It should be noted that the description of tension members and compression members above is for a ball impact loading on the face plate. If the shell has a tensile load rather than a compression load as described above, as will happen during a rebound after impact, the loading on the members or webs forming the shell would be reversed, and the compression members described would carry tension and the tension members described would be loaded in compression.

If all of the tension members described above were eliminated so the shell was diamond shaped rather than triangles, the shell would still be a spring because all of the compression members would be able to bend. The members forming the cells would have to be larger cross section for the same stiffness and the same strength as when the tension members are used, and the spring shell without the tension members forming the triangle cells would weigh at least twice as much.

An advantage of omitting the tension members (e.g. numerals 162 in FIG. 11 and 12) is that the required increase in cross sectional area provides for easier flow of molten casting metal and renders casting easier.

In a further extreme, half of the members 160 of FIG. 12 could be omitted such that the structure is simplified to a set of spiral spring elements loaded primarily in bending. This is shown in FIG. 14. It has the advantage of easier flow of molten casting metal with the penalty of greater weight for the spring structure.

Figure 13:
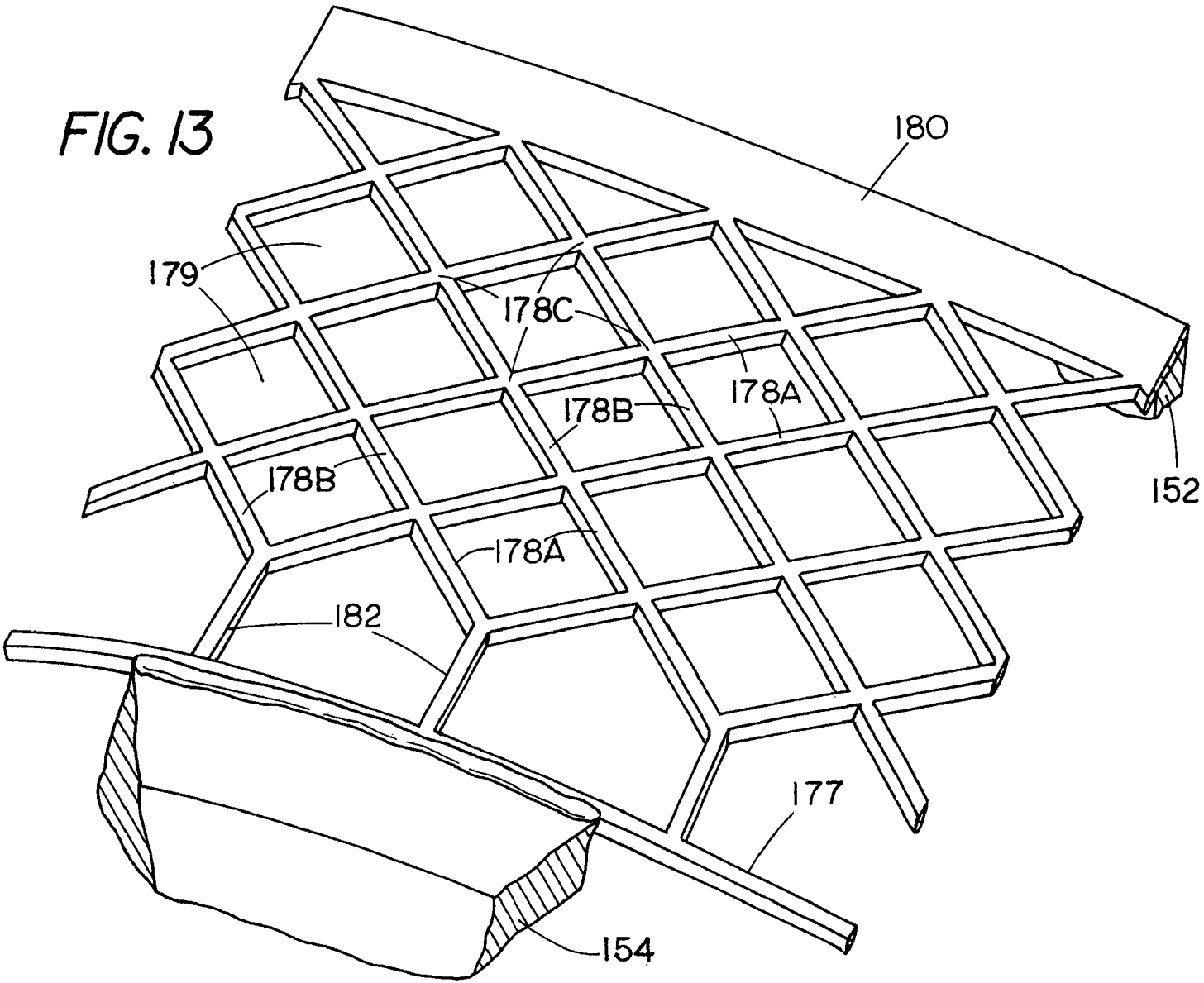
FIG. 13 illustrates a variation that has greater weight but is easier to cast.

In FIG. 13, crossing diagonal spring members 178A and 178B are joined at their intersections 178C to form open spring cells 179. One set of diagonal spring members 178A are parallel to each other and spaced apart, and have ends joined to members 178B at junctions 178C. The second set of diagonal spring members 178B are parallel to each other and spaced apart and join members 178A at junctions 178C to form the spring cells 179.

The loading from an impact on a face plate 154 is across corners of the spring cells 179. The corners of the spring cells adjacent the face plate 154 are connected to carry loads perpendicular to the plane of the face plate 154. The member 177 is parallel to the face plate, and is joined to a periphery of the face plate when it is formed with an open center to form the spring shell. The member 177 is connected to spring cell junctions or corners 178C with columns 182. A rear plate 152 is joined to the strap 180, which in turn is connected to junction corners 178C to transfer loads that are acting diagonally on the spring cells (which are diamond shaped as shown) to the rear plate 152.

Figure 14:
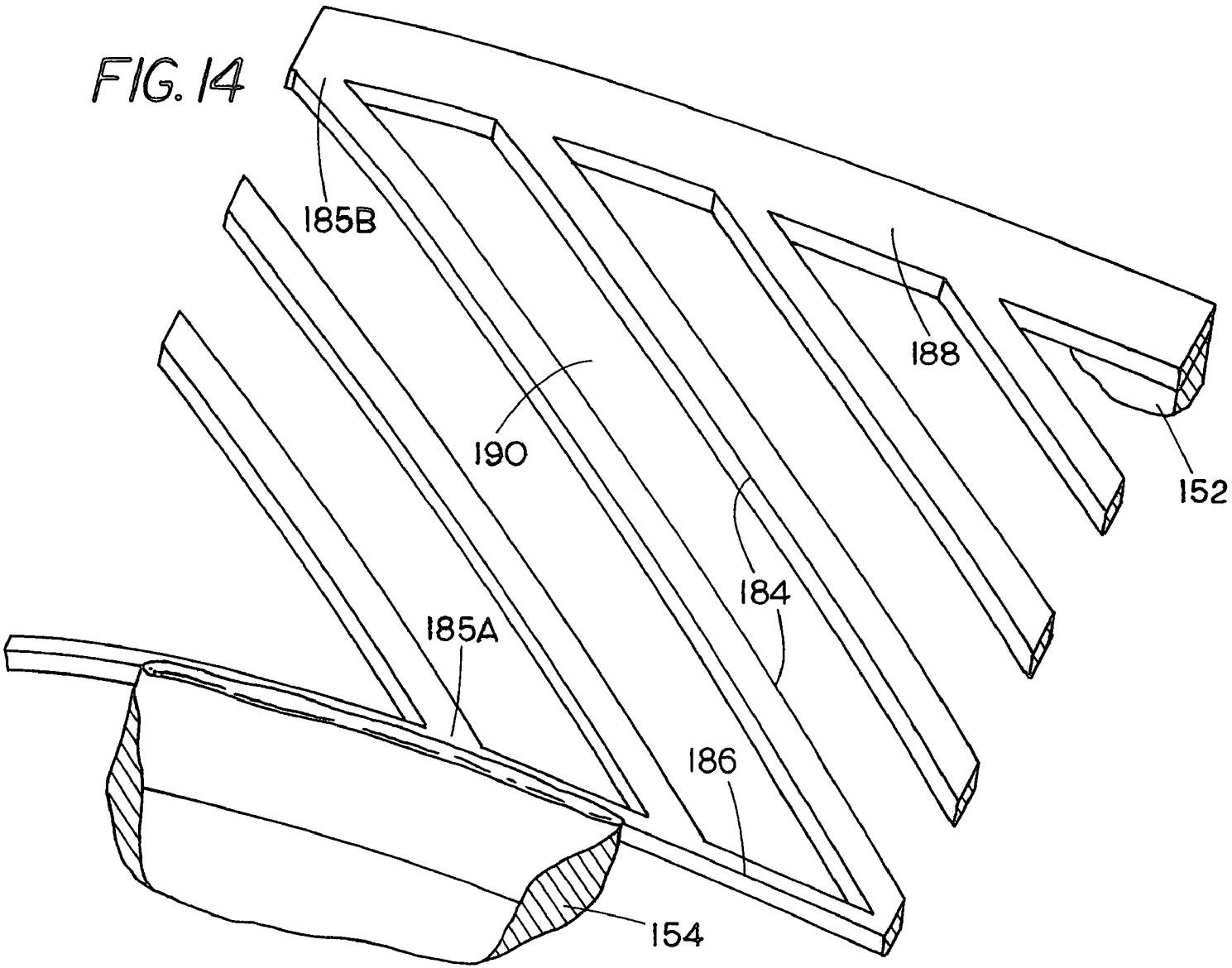
FIG. 14 illustrates another variation also having greater weight and easier to cast.

Another extreme is illustrated in FIG. 14 in which even more spring members or elements are eliminated and the remaining spring members shown at 184 have still greater cross sectional area. As shown, the members 184 are diagonal members that extend from a member 186, which is parallel to the face plate 154 and is welded or joined thereto, and a strap 188 that is attached to the rear plate 152. The ends of the members 184, which are shown at 185A are joined to the member 186, and the opposite ends of the members 184, which are indicated at 185B, are joined to the strap 188. The spring members thus form open spring cells 190, and the spring members 184 are thus loaded primarily in bending when an impact load acting perpendicular to the plane of the face plate 154 is resiliently resisted by the spring members forming the spring cells.

Again, spring members 184 are primarily loaded in bending. The construction of FIG. 14 also has the advantage of still easier flow of molten casting material with the penalty of greater weight for the spring structure. Increasing weight of the spring shell means weight must be removed from other parts such as the face and the rear structure, since total head weight must not become too large as discussed in the book "How Golf Clubs Really Work and How to Optimize Their Designs" by F. D. Werner and R. C. Greig. Low weight of the spring shell also renders it easier to locate the center of gravity optimally and to maximize the moments of inertia of the club head.

In the cases of FIGS. 13 and 14, a compromise may be made to reduce weight. That would be to maintain the same strength but to accept greater stiffness than an optimum, which may be obtained by FIGS. 11 and 12. This causes less elastic energy to be stored in the shell spring and thus less weight in the spring elements.

For best performance with least weight, the preferred embodiment is the full compliment of triangular elements as shown in FIGS. 11 and 12.

The structural members that bound open spacing elements are beams or bars. They are often call "bars" in the following.

At impact, the tension and compression bars that form the individual cells can be considered to be continuous diagonal bars extending from the face plate to the rear plate, with the first bars 43, for example, extending diagonally in a first direction and being spaced apart, and second bars 43A extending in an opposite diagonal direction with the bars joined at their intersection points. When bars 43 and 43A are in compression, they cause tension in bars 44. Together, they form the triangular spring cells.

Likewise, the spring bars shown in the other forms of the invention, such as a first set of the bars 160, are arranged in two different diagonal directions to each other and can be considered to extend from the junction with the face plate to the rear plate. The first set of diagonal bars 160 is joined to the second set of bars 160 at the intersections to form their spring cells. When bars 160 are in compression they cause tension in bars 162. This is also shown more clearly in FIG. 13, where the bars 178A form one set of diagonal bars, and the bars 178B form the other set of diagonal bars, and they are joined to each other at their intersections, The effective load carrying capability is continuous along these diagonal bars from the face plate to the rear plate.

It was mentioned above that the central body b could be covered, and a somewhat flexible material would be used. A thin layer of polyurethane having a hardness rating of about 75D Shore hardness is suitable. Such a cover layer or coat adds little to the strength and stiffness of the structure, or weight. The cover could be made of other materials.

The spring shells that are shown can be made in flat layout, and then formed around an open space so that the bars that join the face plate will be attached adjacent to the periphery of the face plate, and the strap or bars that joins the rear plate will also be around the periphery of the rear plate. The spring shell can be in some other configuration. The spring shell could taper to a smaller size opening adjacent the rear plate, for example. The flat structure can be formed into the open center or tubular spring shell shape as shown in FIG. 12, and the spring cells at the opposite ends of the flat layout form will meet when the shell is formed into the open center or tubular spring shell.

A possible, closely related, optional configuration is the addition of tension and/or compression bars internal to the described shell and connecting to at least some of the bars that constitute the shell, thus modifying said "shell" to become a "rear structure".

Figure 15:
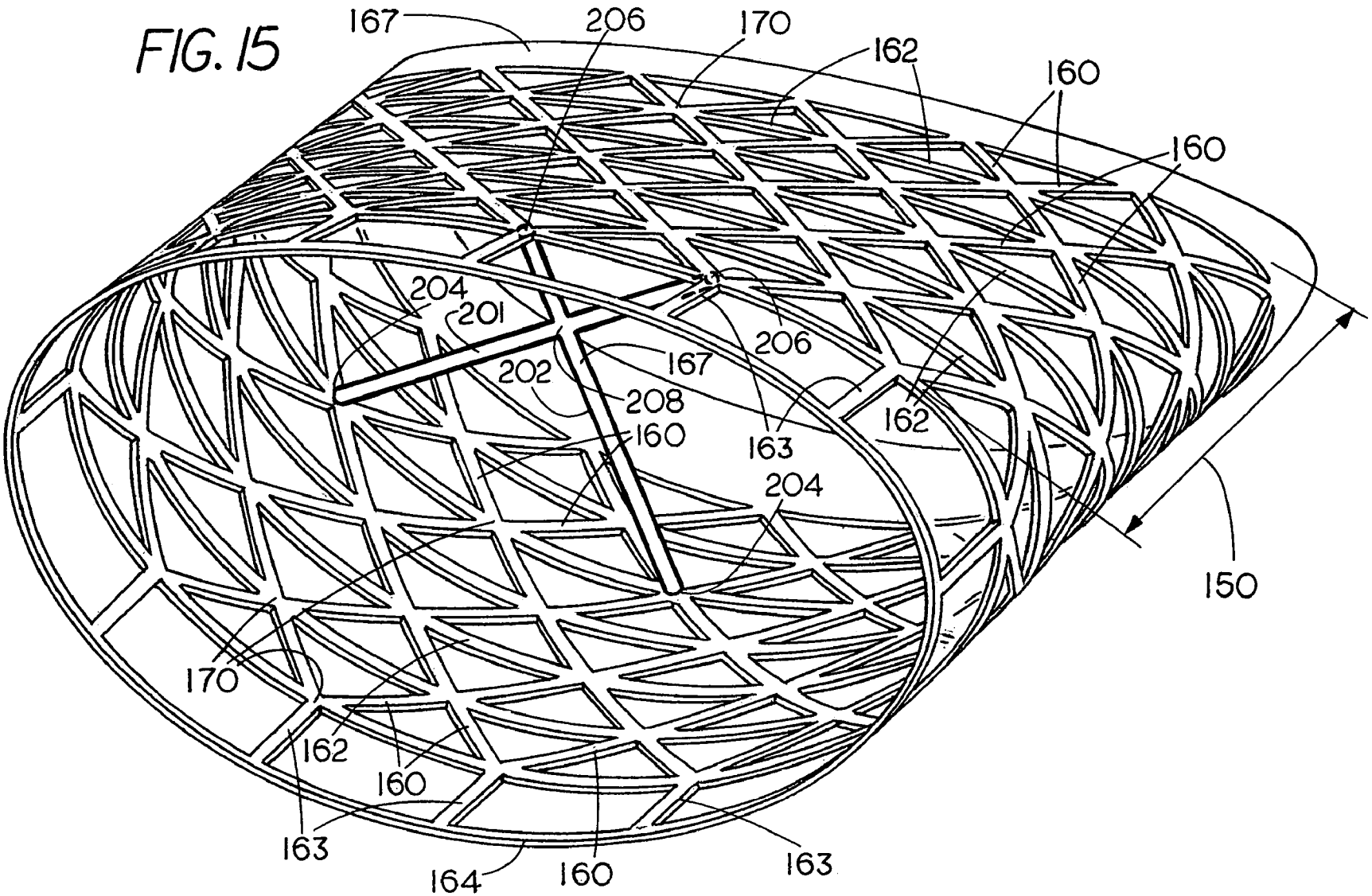
FIG. 15 is a view of a further modified embodiment of the spring shell showing internal bars that support outer bars.

FIG. 15 is similar to FIG. 12 and shows two internal bars 201 and 202 in bold lines. They represent two of a multiplicity of such internal bars that may support the outer bars such as 160 in FIG. 12 that form the formed shell spring in other embodiments. The internal bars 201 and 202 are joined to outer bars such as 160 at intersections 170 at locations shown at 204 and 206. The bars 201 and 202 are joined to each other where they may intersect as shown at 208. The bars 201 and 202 span the open center of the formed spring shell and resist a tendency of the formed spring shell to flatten. The bars 201 and 202 support the outer bars, such as bars 160, against buckling failure and contribute to the overall spring effect. This is referred to as the "spring structure having internal members" in the claims.

It should be noted that the bars 201 and 202 are at an angle with respect to a plane defined by the face plate and member 169. The locations 206 are at an intersection 170 adjacent the member 164 and thus the face plate, and the locations 204 are offset toward the rear strap 167.

An advantage for such configuration is that it can support the shell portion against buckling of the assembly of spring elements in the shell, and if desired, from buckling of individual bar elements in the shell structure. A disadvantage is more difficult manufacturing. In addition, it adds mass near to the center of gravity and thus reduces the moments of inertia when total head weight is not increased. This optional rear structure configuration is illustrated only in one form but can have many obvious variations.

Cross sectional shapes of the exterior of the rear structure as viewed in planes generally perpendicular to the front-rear direction may be round, elliptical or other shape such as the corresponding shapes of the rear portions of conventional club head designs. In addition, such cross sectional shapes may vary in both shape and size from front to rear.

All bar configurations described as having bending stresses or as tension and compression stresses are statements of close approximation. In fact, bars bounding triangular openings and are described as having tension and compression stresses deform and slight bending stresses are a result, which are generally relatively quite small but they do exist. Similarly, bars bounding openings that are of diamond shape are primarily stressed in bending, but do have small compressive stresses during impact. This is also true of bars bounding openings that are of trapezoidal shapes.

A further variation of possible value is to combine above-described structures. An example would be to have a portion of the structure having triangular openings with the structure having diamond-shaped openings and/or the structure having trapezoidal openings. The transition zones between two sets of such openings may vary. At least one process would be to provide a ring of significant strength and stiffness terminating one configuration on one side of such ring and beginning a different configuration on its other side. It is highly desirable for the final club head design to meet the standards of the United States Golf Association or other standards and a combination may be of value in adjusting the desired head weight, mass distribution, and compressive stiffness as may be required at present or in future standards.

Alternate configurations have similar elements, also called bars, that are primarily loaded in bending stress with relatively little compression stress. Combinations of bars having each kind of stress are also possible.

The features include:

1. Use of openings in the shell to permit greater deformation when loaded in compression during impact, with a minimum weight.

2. In the preferred embodiment, such openings consisting of triangular openings in the shell bounded by bars such as to cause such bars (also called "members") to be primarily loaded in reasonably uniform compression and tensile stresses.

3. Such openings of feature 1 being a combination of triangular and quadrilateral shape (FIG. 7).

4. Such openings in feature 1 being of quadrilateral shape (FIG. 8).

5. Such openings of feature 1 being of nearly parallelogram shapes, the structural elements being loaded in bending with little pure compression or tension (FIGS. 13 and 14).

Although the present invention has been described with reference to preferred embodiments, workers skilled in the art will recognize that changes may be made in form and detail without departing from the spirit and scope of the invention.

What is claimed is:

1. A shell structure for a golf club head of a metal wood type, said shell structure connecting a face plate structure to a rear plate structure spaced in a front to rear direction and providing a tubular spring effect section elongated in the front to rear direction defining a periphery, said tubular spring effect section being formed of bars at acute angles to said face plate structure, said bars being in two groups such that the bars of each group are approximately parallel to other bars in the respective group and such that bars of one such group intersect bars of the other group at acute angles to form diamond shaped openings, said bars being joined where they intersect and joined at front ends to said face plate structure adjacent a periphery of the face plate structure and at rear ends to said rear plate structure adjacent a periphery of the rear plate structure.

2. The shell structure of claim 1 wherein said spring effect section comprises a plurality of secondary bars that span an open center space formed by the tubular cylinder and having ends which are joined to the face plate structure and rear plate structure, the bars being loaded in one of the loadings of a group consisting of bending stress, substantially pure tension and compression stresses, or a combination of both, and said secondary bars crossing and being joined where they cross and forming open cells that deform upon application of the load when said face plate structure strikes a ball.

3. The shell structure of claim 1, wherein said tubular spring effect section is of a cross sectional shape generally perpendicular to the front to rear direction being chosen from a group consisting of round, elliptical, and the shape of the periphery of said face plate structure, said cross sectional shapes further varying in front to rear direction, said varying cross sectional shape chosen from a group consisting of size, cross-sectional shape, and size combined with cross-sectional shape.

4. The shell structure of claim 1 wherein a third group of bars is included in the shell structure and each bar of said third group of bars is generally parallel to said face plate structure and intersects bars of the first and second groups of bars substantially at intersections between bars of said first and said second groups of bars, a combination of the bars of the first, second and third groups forming triangular openings, wherein all bars are joined together at each of such intersections, and during impact of said face plate structure with a ball, said first and second groups of bars experience primarily compression stresses and said third group of bars experiences primarily tension stress in most of such openings.

5. The shell structure of claim 4 wherein the bars of said third group of bars that are in tension are present only at selected bar intersections that are loaded in compression so as to form said shell structure as a mixed assembly of triangular openings and diamond-shaped openings.

6. The shell structure of claim 4 wherein the bars of the groups of bars experiencing tension and compression form trapezoidal shapes wherein at least some bars generally parallel to said face plate structure alternate between long sections that are tension members and short sections that are compression members while all members not generally parallel to said face plate structure are principally compression members.

7. The shell structure of claim 1, wherein said bars are formed of a titanium alloy.

8. The shell structure of claim 1 wherein at least some intersections of bars nearest said face plate structure are joined only to compression bars that are nominally parallel to the front to rear direction of said shell structure and the other ends of such compression bars are joined to a perimeter of said face plate structure and are joined to one or more bars substantially parallel to said face plate structure to provide improved structural support against buckling of said at least some bars that are parallel to the front to rear direction.

9. The shell structure of claim 1 and a thin coat of soft material on the shell structure, said coat covering all openings in said spring effect section.

10. a golf club head of a metal wood type having a face plate with a ball striking surface, and a rear plate defining a rear portion of the golf club head, and a tubular spring shell formed around an open center and being joined to a peripheral portion of the face plate and to the rear plate and forming the support for the face plate relative to the rear plate, and a hosel on the club head, said tubular spring shell comprising a plurality of diamond shaped spring cells each made of four bars, said four bars being joined at each corner so as to form a diamond shape having one apex toward said face plate and an opposite apex toward said rear plate, the plurality of spring cells made of four-bars shapes forming a continuous arrangement of diamond shaped openings, each of said diamond-shaped openings being bounded by four bars joined together at corners, said tubular spring shell having an enclosed cross-sectional shape as view perpendicular to a fore-aft direction from said face plate to said rear plate, a fore-aft length of said tubular spring shell corresponding to a fore-aft dimension between said face plate and said rear plate, and with said diamond-shaped openings having apexes nearest said face plate joined to said face plate, and with the diamond-shaped openings with apexes nearest said rear plate joined to said rear plate, said bars being made of resilient material.

11. The golf club head of claim 10 wherein apexes of each diamond shaped spring cell spaced from the front plate and rear plate, respectively, are joined by separate bars that are in tension during impact of a ball on the face plate so as to form triangular openings and such separate bars in tension resiliently reducing bending stresses in said four bars forming each diamond-shaped spring cell having a separate bar.

12. The golf club head of claim 11 in which at least some apexes of said triangular openings nearest said face plate and unconnected relative to said face plate are joined to parallel bars that are substantially parallel to the fore-aft direction, and with such parallel bars joined to said face plate at their forward ends and joined to one or more bars substantially parallel to said face plate to thereby provide structural support against buckling of said bars that are parallel to the fore-aft direction.

13. The golf club head of claim 12 wherein said at least some apexes of said triangular openings nearest said face plate and at least some apexes of said triangular openings nearest the rear plate form a substantially straight line generally parallel to the fore-aft direction.

14. The golf club head of claim 11, wherein the tension carrying bars lie substantially along planes parallel to the face plate.

15. A spring shell for a golf club head of a metal wood type extending between a face plate have a hosel formed thereon and a rear plate, said spring shell comprising a plurality of resilient bars that extend at diagonals in a first direction at acute angles relative to a plane of the face plate, and have ends joined to the face plate and rear plate, respectively, a plurality of second bars substantially identical to the first bars spaced apart and positioned at acute angles to the said face plate, and intersecting the first bars, the second bars having ends joined to the face plate and rear plate respectively, said first and second bars being joined together at junctions where they intersect to form generally diamond shaped spring cells between the face plate and rear plate, said spring shell being formed to be a continuous elongated tube to form said golf club head.

16. The spring shell of claim 15, and third bars capable of carrying tension lying along planes substantially parallel to the face plate and joined substantially at the apexes of junctions of the first and second bars of at least some of the spring cells, said apexes being spaced from at least one of said face plate and said rear plate, to tend to reduce the amount of separation of the apexes in the direction of long axes of said third bars, for at least some of the said apexes when the first and second bars are loaded in compression.

17. The spring shell of claim 16, wherein a periphery of the continuous tube spring shell is joined to the face plate around a periphery of the face plate.

18. The spring shell of claim 17, wherein said bars are dimensioned to provide a desired level of spring resistance to deformation when the face plate is subject to impact.

19. The spring shell of claim 15, wherein the first bars are positioned at included angles of between 40 and 140 degrees relative to the first bars.

20. The spring shell of claim 15 and third bars forming the spring shell substantially parallel to said face plate and sharing junctions with said first and second bars to form generally triangle-shaped spring cells between the face plate and rear plate, the triangle-shaped spring cells being oriented with the junctions of each triangle-shaped spring cell lying along lines generally perpendicular to said face plate.

* * * * *